United States Patent [19]

Van Horn

[11] Patent Number: 4,899,864

[45] Date of Patent: Feb. 13, 1990

[54] MULTIPLE COIN MECHANISM FOR A VENDING MACHINE

[75] Inventor: Roger Van Horn, Waconia, Minn.

[73] Assignee: Protocol, Inc., Mendota Heights, Minn.

[21] Appl. No.: 217,156

[22] Filed: Jul. 11, 1988

[51] Int. Cl.[4] ..... G07F 5/02

[52] U.S. Cl. ..... 194/237; 194/292

[58] Field of Search ..... 194/236, 237, 255, 258, 194/292

[56] References Cited

U.S. PATENT DOCUMENTS

| | | | |
|---|---|---|---|
| 917,986 | 4/1909 | Anthony | 194/292 |
| 1,175,139 | 3/1916 | Eddings et al. | 194/292 |
| 1,313,032 | 8/1919 | Webster | 194/258 X |
| 3,970,181 | 7/1976 | Rubio | 194/332 X |
| 4,363,393 | 12/1982 | McDonald | 194/237 |
| 4,673,074 | 6/1987 | McCormick | 194/236 |

*Primary Examiner*—F. J. Bartuska

*Attorney, Agent, or Firm*—Moore & Hansen

[57] ABSTRACT

A simple coin mechanism for a vending machine is disclosed. The coin mechanism includes a coin carrier designed to review all of the required coinage at one time. The coin mechanism also includes a separate spring loaded coin pawl and ejector cam for each coin. Finally, the coin mechanism includes a backup panel which prevents actuation of the vendor by reverse rotation of the coin carrier.

7 Claims, 1 Drawing Sheet

MULTIPLE COIN MECHANISM FOR A VENDING MACHINE

BACKGROUND OF THE INVENTION

This invention relates to coin operated vending machines and, more specifically, to the simple coin mechanism for use in conjunction with such machines. Included within the vending art are many coin mechanisms which are intended to ensure that correct coinage has been inserted into a machine before the vending operation takes place. However, in recent years, the trend has been toward more complicated electronic coin mechanisms which not only perform this traditional function, but also are utilized to perform accounting operations or to electronically change price. These more complicated coin mechanisms are obviously suitable for vending machines intended to handle many of items to be sold at different prices. However, they are far too expensive to be used in conjunction with low volume, single price, single item vending machines.

While most companies in the field are working on the development of complicated coin mechanisms of the type described above, several have directed their attention toward developing more simplified coin mechanisms. For example, National Sanitary Laboratories, is the assignee of U.S. Pat. Nos. 3,970,181 issued in July of 1976 and 4,673,074 issued in June of 1987. The '181 patent discloses a coin operated mechanism which dispenses merchandise upon insertion of two coins of predetermined denominations and certain manipulation by the customer. The device of this patent includes a coin receiving wheel having diametrically opposed coin receptacles. The coin receiving wheel must rotate a full 360 degrees (180° for each coin) to effect the dispensing operation. The mechanism of the '181 patent is rather complex, including among other parts, an actuator plate and clutch provided by a cam flange, a drive plate and a drive pawl. These parts are rather expensive to manufacture and, additionally, contribute to assembly cost.

The '074 patent, on the other hand, is directed to two specific improvements of the '181 Patent design. First, the '074 patent attempts to provide a simpler coin mechanism which can be converted to cause the machine to dispense upon insertion therein of a selectable combination of more than two coins of predetermined denominations. Second, when the machines are so converted, the '074 design permits dispensing to incur upon the insertion of two or more coins, but with only 180° rotation of the coin receiving wheel. Still, however, the apparatus requires coins to be inserted into two separate slots or chambers before a vend can occur. Further, the knob must be rotated some amount to permit the required insertion of coinage into the second slot. Despite the benefits claimed in the '074 and '181 patents, the products described in these patents are difficult to assemble and operate and expensive to manufacture. Also, because, in both cases, the knob must be rotated to some extent to deposit additional coinage, operation is clumsy. The present invention was developed to provide (a) a simple multiple coin mechanism with (b) a minimum number of parts which (c) can be easily and inexpensively manufactured, (d) is resistant to jackpoting, and (e) which permits all of the required coins equal to the vend price to be deposited at one time before rotation of the vend knob is required to release the product.

SUMMARY OF THE INVENTION

In the preferred embodiment of the present invention, a face plate supports all of the functional parts of the entire coin mechanism. Attached to the rear surface of the face plate are left and right spacer plates, a coin carrier having diametrically opposed coin slots which are each capable of carrying a predetermined number of coins of predetermined denominations, and a separate assembly including spring biased coin pawls and an ejector cam for each of the predetermined number of coins. The preferred embodiment also includes a spring-loaded backup pawl which is associated with one of the spacer plates to prevent the retrieval of the coins once deposit is made and the vend knob is turned slightly.

The unique construction of the present invention, for example, permits the simultaneous deposit of three quarters within the coin chamber in the coin carrier. With only slight modification the coin mechanism can be converted to accommodate a vend price of a lesser or greater number of quarters, or for that matter, coins of different denomination. Once the requisite number of coins have been deposited, the coin carrier is then rotated to a position where the left spacer plate engages the coins and forces them simultaneously inwardly toward the associated spring biased coin pawls until the coin pawls are depressed to permit further rotation of the coin carrier. Once the coin carrier has been rotated a full 180°, the coins drop into a coin box and the machine cycles through delivering one unit of the product. Reverse rotation of the coin carrier is prohibited by the spring loaded backup pawl which engages peripheral cut outs in the coin carrier.

DESCRIPTION OF THE DRAWINGS

The preferred embodiment of the invention is described below with reference to the accompanying drawings herein.

DETAILED DESCRIPTION OF THE PREFERRED EMBODIMENT

Figure 1:
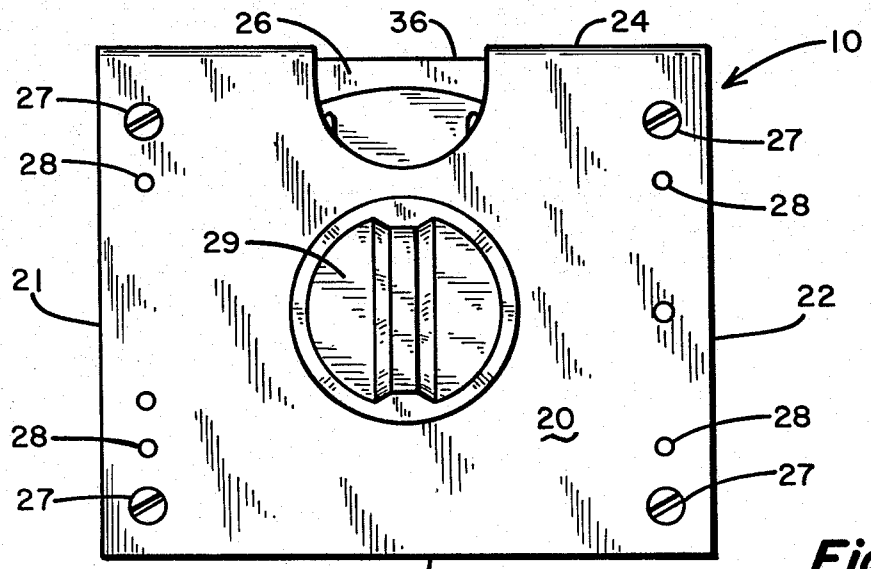
FIG. 1 is a front elevation of the preferred embodiment of the invention.

A simple coin mechanism 10 of the present invention, as seen by the customer, is shown in FIG. 1. The mechanism includes a front face plate 20 to which all of the other components of the coin mechanism are secured. The face plate 20 has side edges 21 and 22, a bottom edge 23 and top edge 24. Projecting rearwardly from the top edge 24 is wall member 25. The top edge 24 and the wall member 25 are formed to include a coin receiving slot 26.

Further shown in FIG. 1 are four mounting screws 27 which are associated with the four corners of the face plate. Screws 27 passing through bores are used to mount the coin mechanism to the vending machine. The front face plate also includes a plurality of indexing bores 28 which are used to properly position various components. Finally, FIG. 1 shows the knob 29 used by the customer to actuate the coin mechanism 10 and vending machine after the deposit of the required coinage.

Figure 2:
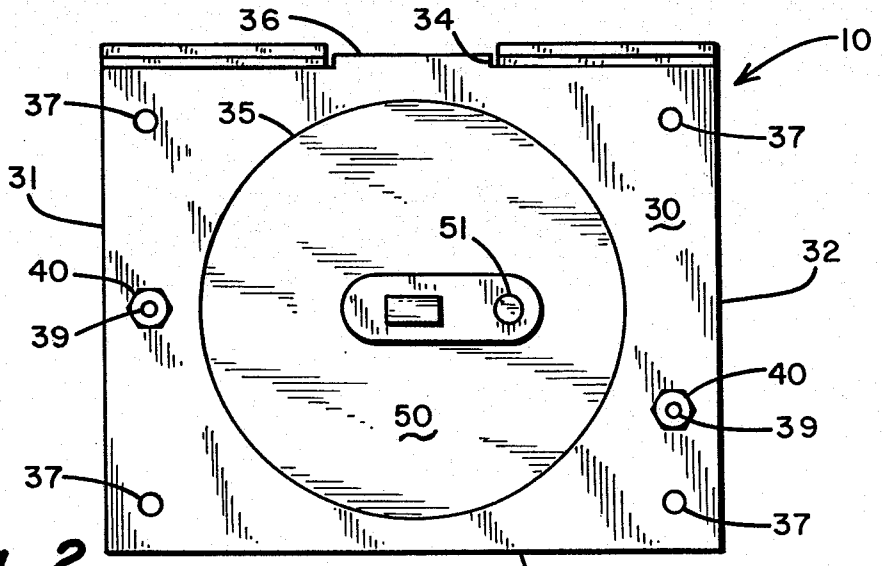
FIG. 2 is a rear elevation of the preferred embodiment.

Referring now to FIG. 2, what is shown is a rear view of the coin mechanism 10. More specifically, FIG. 2 shows a back plate 30 having two side edges 31 and 32, a bottom edge 33, a top edge 34, and a center circular cut out 35. Associated with the top edge is an upwardly projecting member 36 which is received within the back of the portion of the coin receiving slot 26 associated with wall member 25.

Other structures associated with back plate which are shown in FIG. 2 are mounting bores 37 which are aligned to receive screws 27 for mounting the coin mechanism 10 to the vendor. Two additional bores are also present for receiving threaded screw members 39 which, in conjunction with lock nuts 40, secure the back plate 30 to the remainder or the coin mechanism 10. Finally, FIG. 2 also shows the back of the coin carrier 50 and the associated actuator 51 which is intended to be coupled to the vending linkage (not shown) of the vending machine (also not shown). Rotation of the coin carrier 50 approximately 180° degrees will cause the actuator 51 to trigger the vending linkage causing a single item to be vended.

Figure 3:
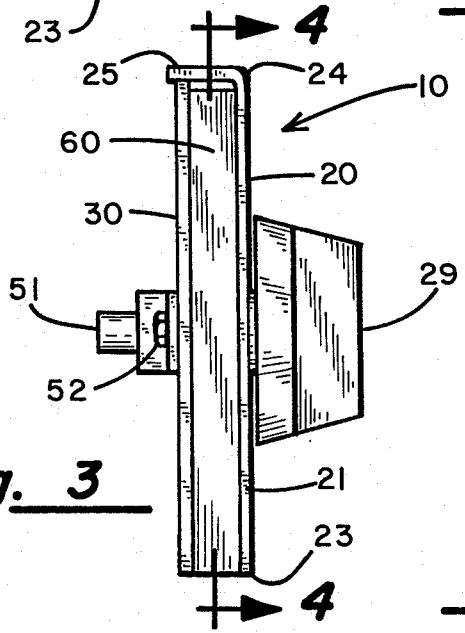
FIG. 3 is a side elevation of the preferred embodiment.

FIG. 3 shows much of the same structure previously discussed such as the front face plate 20, the top wall member 25, the knob 29, the back plate 30 and the actuating means 51. Also shown is the right spacer 60 and the screw 52 which is used to secure the knob 29 to the join carrier 50. The coin mechanism 10 also includes a left spacer 61 which, to some degree, corresponds to the right spacer 60. The physical relationship between the right spacer 60 and the left spacer 61 is most clearly shown in FIG. 4.

Figure 4:
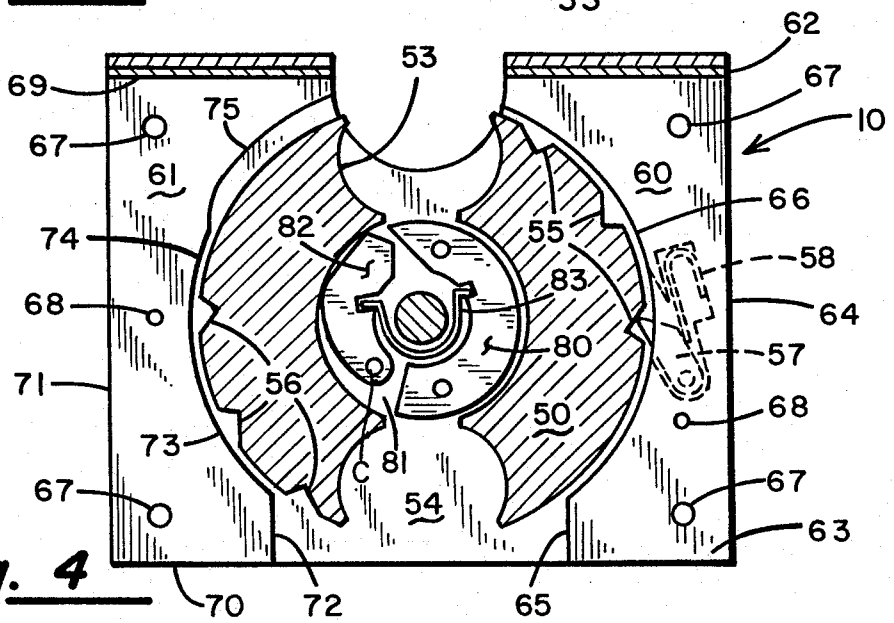
FIG. 4 is a cross-section along line 4—4 of FIG. 3.

As shown in FIG. 4, the right spacer includes a top edge 62, a bottom edge 63, a straight outer edge 64 and an inner edge 65 which includes a concave arcuate section 66. Concave section 66 has essentially the same radius of curvature as the cylindrical coin carrier 50.

Each of the spacers 60 and 61 include bores 67 which are intended to be aligned to receive mounting screws 27. Again, such alignment is essential so that the coin mechanism can be mounted to the vendor. Each of spacers 60 and 61 similarly includes a bore 68 intended to be aligned to receive screw members 39 so that the back plate 30 can be secured to the coin mechanism. Spacers 60 and 61 also include cylindrical indexing posts (not shown) which mate with indexing bores 28 of the face plate 20 to ensure the proper positioning of components.

An important element of the present invention is the design of the left spacer 61. It has a top 69, a bottom 70, an outside edge 71 and an inside edge 72 which, along its major portion, includes a two section concave cutout 73. A section 74, comprising approximately two-thirds of the cut out 73, has substantially the same radius of curvature as the coin carrier 50. However, the top section 75 has a slightly larger radius than the outer edge of the coin carrier.

The coin carrier 50 includes a pair of diametrically opposed coin chambers 53 and 54. The coin carrier also includes along its outer edge and diametrically opposed with respect to each other, six triangular shaped peripheral cut outs 55 and 56 which are intended to engage backup pawl 57 to prevent rearward rotation of the coin carrier 50 beyond a particular point. The backup pawl 57 is located within a molded cut out in the right spacer 60 and is therefore hidden from view in FIG. 4 and shown in phantom line. This cut out is also designed to accommodate and receive a biasing spring 58 which is intended to force the tip of the backup pawl 57 into the peripheral cut outs 55 and 56 as they pass the backup pawl 57.

FIG. 4 also clearly shows an ejector cam 80, a large plastic spacer 81, a coin pawl 82, and a biasing spring 83. Biasing spring 83 is intended to outwardly bias the upper portion of the coin pawl 82. As is clearly shown in the drawings, the ejector cam 80 is fixed at two points so that it will not rotate. However, the coin pawl 82 is only secured at one point, C, so that it can pivot when sufficient force is applied to it.

The various structures shown in FIG. 4 will work if one coin is deposited in the coin slot and the knob is rotated. If it is desirable for pricing purposes to require more than one coin, additional spacers 81, ejector cams 80, coin pawls 82 and biasing springs 83 are placed in face-to-face registration with the corresponding parts shown in the drawings. For example, if it is desirable to vend a 75 cent item using the coin mechanism, there would be three sets of each of these components illustrated in FIG. 4. Each separate coin would trigger a separate set of these components as described below.

When the coin mechanism of the present invention is in use, the required number of coins are deposited into the coin slot 26 and received in either coin receiving chamber 53 or coin receiving chamber 54, depending upon which is aligned with the coin slot 26. The customer then rotates knob 29 in a clockwise direction (when viewed as in FIG. 1) until the coins engage the area where the top section 75 and the bottom section 74 of the concave cut out 73 of left spacer 61 meet. The change in the radius of curvature of the concave cut out 73 forces the coin or coins inwardly until they engage the associated coin pawls 82. If the proper number of coins of the proper denomination are present, further rotation of the knob will cause the coins to be forced inwardly by the left spacer 61 with sufficient force to overcome the force of the biasing spring(s) 83. If sufficient coins of the proper denomination are deposited, then each will force its associated coin pawl inwardly against its biasing spring and permit further rotation of the knob to actuate a vend. However, if an insufficient number of coins are deposited, or if coins of improper denomination are deposited, one or more of the coin pawls will not be forced inwardly thus precluding further rotation of the coin carrier in the clockwise direction and, in effect, inhibiting the vend. Once the knob has been rotated approximately 180°, each of the coins located in the coin carrier will come into contact with the ejector cam which will force the coins out of the coin carrier and into a coin box located below the coin mechanism 10.

Given the relationship between the actuating means 51 and the associated linkage of the vending machine, rotation of the coin carrier 180° in the counterclockwise direction could also cause a vend unless such counterclockwise rotation was inhibited. It is for this reason that backup pawl 57 and biasing spring 58 are present. The biasing spring 58 causes the backup pawl 57 to mate with the triangular cut out 55 or 56 of the coin carrier to inhibit backward rotation of the coin carrier.

As those skilled in the art will recognize from the detailed description provided above, the invention may be embodied in other specific forms without departing from its spirit and its central characteristics. For example, the spacers 60 and 61 may be a stack of laminated metal plates, each corresponding generally in thickness to the thickness of the coin to be used. The number used would then be determinative of the vend price. Alternatively, the spacers may be molded as a single piece from plastic and of the appropriate dimension to allow the vend price to be deposited, using coins of a given denomination. The described embodiments are to be considered in all respects as only illustrative and not restrictive and the scope of the invention is, therefore, indicated by the appended claims rather than the foregoing description. All changes which come within the meaning and range of equivalency of the claims are to be embraced within their scope.

What is claimed is:

1. For ensuring, before an item is vended, the deposit of a predetermined number of coins of a predetermined denomination into a vending machine having a vending linkage for controlling the dispensing of an item, a coin mechanism comprising:

(a) a front plate, said front plate including a coin slot;

(b) a rotatable knob having a shaft passing through the front plate;

(c) a cylindrical coin carrier fixed to said shaft for rotation therewith, said coin carrier including a pair of diametrically opposed coin members each of which are alignable with said coin slot, the coin chambers being dimensioned to receive at least one coin of a given denomination in face-to-face relation therein, at least two peripheral cut outs formed in said coin carrier, and an actuator means for coupling the coin carrier to the vending linkage of the vending machine to cause said vending machine to vend an item only upon 180 degree rotation of said coin carrier;

(d) at least one spring biased coin pawl equal in number to the number of coins required to meet the vend price pivotally affixed to said front plate;

(e) a first spacer plate means for engaging the coins upon rotation of said knob and coin carrier in a first direction to force each of said coins against its associate spring biased coin pawl to permit 180 degree rotation of said coin carrier in said first direction only when the number of coins of the given denomination equal to the vend price are present in one of said coin chambers;

(f) coin ejector means affixed to said front plate for ensuring that all coins exit said coin chamber of said coin carrier when the coin carrier is rotated approximately 180; and (g) a spring loaded backup pawl for mating with the peripheral cut outs formed in said coin carrier to prevent 180 rotation of the coin carrier in a second direction opposite said first direction.

2. The apparatus of claim 1 further including a back plate attached to said front plate with said first spacer plate means disposed therebetween.

3. The apparatus of claim 2 wherein said back plate has a central circular opening intended to mate with said coin carrier.

4. The apparatus of claim 2 wherein said front plate and said back plate have aligned bores therethrough which are intended to receive means for mounting said coin mechanism to said vending machine.

5. The apparatus of claim 1 wherein said coin carrier is made of a molded plastic.

6. The apparatus of claim 1 wherein said first spacer plate means has a top edge, a bottom edge, an outside edge and an inside edge, said inside edge including, along its major portion a first concaved cut out having a radius of curvature substantially equal to the radius of curvature of the coin carrier and an adjoining second concaved cut out having a different radius of curvature.

7. The apparatus of claim 6 having a second spacer plate having a top edge, a bottom edge, an outside edge and an inside edge, said inside edge having along its major portion a cut out having a radius of curvature substantially equal to the radius of curvature of the coin carrier.

* * * * *